US006095740A

United States Patent [19]

Hollenstein et al.

[11] Patent Number: 6,095,740

[45] Date of Patent: Aug. 1, 2000

[54] METHOD OF MANUFACTURING BOOKS OR BROCHURES

[75] Inventors: Hans Hollenstein, Guntershausen; Walter Meier-Germann, Frauenfeld, both of Switzerland

[73] Assignee: GRAPHA-Holding AG, Hergiswil, Switzerland

[21] Appl. No.: 09/111,575

[22] Filed: Jul. 8, 1998

[30] Foreign Application Priority Data

Jul. 25, 1997 [EP] European Pat. Off. ..... 97810531

[51] Int. Cl.[7] ..... B42B 1/02

[52] U.S. Cl. ..... 412/4; 412/2; 412/6; 412/35; 412/36; 270/52.26; 270/52.29; 270/58.07; 270/58.08; 271/175

[58] Field of Search ..... 412/2, 4, 6, 35, 412/36; 270/52.26, 52.29, 58.07, 58.08; 271/175

[56] References Cited

U.S. PATENT DOCUMENTS

| | | | |
|---|---|---|---|
| 3,786,979 | 1/1974 | Müller . | |
| 4,198,039 | 4/1980 | Bryson et al. | 270/52.29 |
| 4,546,961 | 10/1985 | Majewski et al. | 270/52.29 |
| 4,614,290 | 9/1986 | Boss . | |

FOREIGN PATENT DOCUMENTS

| | | |
|---|---|---|
| 0537106 | 4/1996 | European Pat. Off. . |
| 0603126 | 7/1997 | European Pat. Off. . |

*Primary Examiner*—Willmon Fridie, Jr.
*Assistant Examiner*—Mark T. Henderson
*Attorney, Agent, or Firm*—Friedrich Kueffner

[57] ABSTRACT

A method and an apparatus for manufacturing books or brochures with a book block of printed sheets which are thread-stitched at the side of the fold, wherein the method includes successively and in a predetermined sequence supplying the printed sheets spread in the middle and with the side portions thereof directed downwardly to a stitching saddle which interacts with a stitching device arranged at a right angle relative to the fold of the printed sheets. The printed sheets are positioned on the stitching saddle in accordance with the stitching position and are subsequently transferred to the stitching device for sewing the printed sheets into book blocks. The method further includes aligning the trailing edge of a supplied printed sheet on the stitching saddle flush on the right hand side in accordance with one of the top edge and the bottom edge of a book block which has at least been partially sewed by the stitching machine.

7 Claims, 1 Drawing Sheet

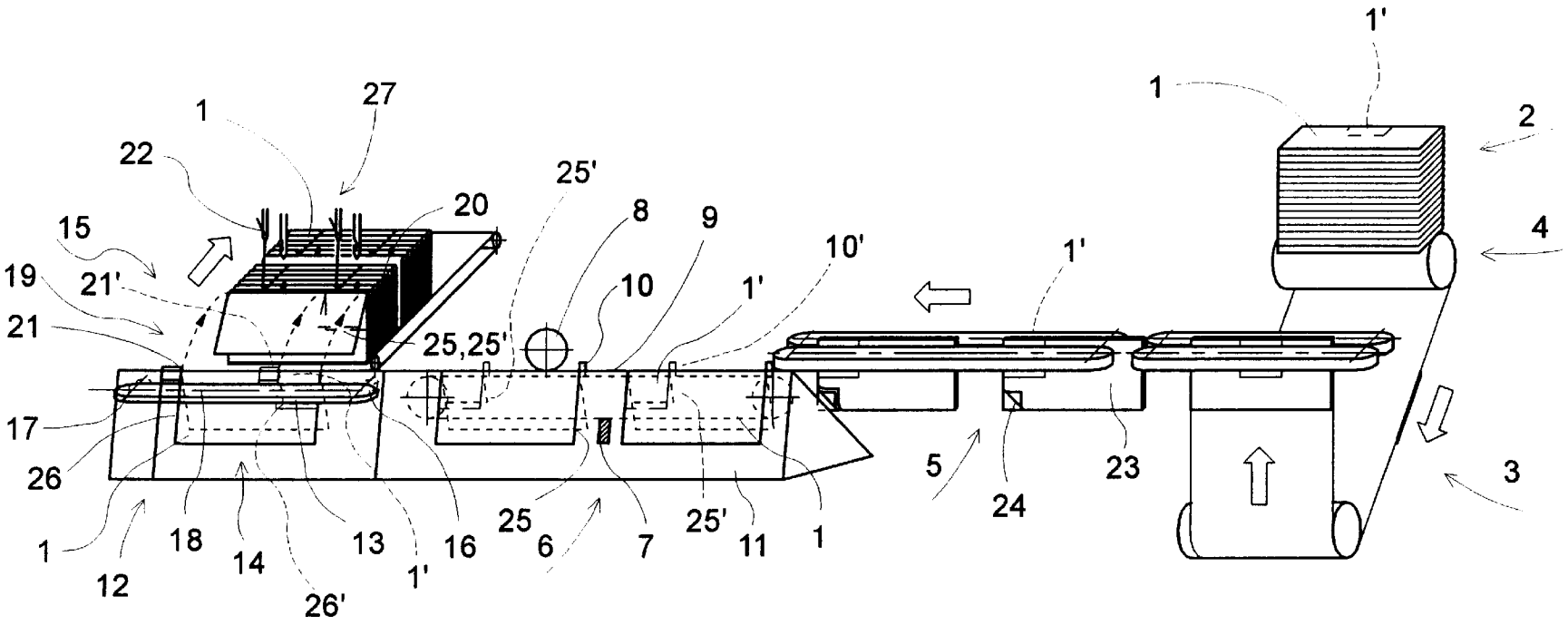
2
4
3
1'
1
23
1'
24
5
10'
1
1'
11
9
25'
8
10
7
25'
6
25
20
25,25'
16
27
1'
13
26'
1
14
22
18
15
21'
12
19
21
17
26
1

METHOD OF MANUFACTURING BOOKS OR BROCHURES

BACKGROUND OF THE INVENTION

1. Field of the Invention

The present invention relates to a method of manufacturing books or brochures with a book block of printed sheets which are thread-stitched at the side of the fold. The method includes successively and in a predetermined sequence supplying the printed sheets spread in the middle and with the side portions thereof directed downwardly to a stitching saddle which interacts with a stitching device arranged at a right angle relative to the fold of the printed sheets. The printed sheets are positioned on the stitching saddle in accordance with the stitching position and are subsequently transferred to the stitching device for sewing the printed sheets into book blocks.

2. Description of the Related Art

Methods of the above-described type are carried out, inter alia, with thread stitching machines of the type "Inventa" of Müller Martini Buchbindesysteme AG.

In accordance with these methods, the printed sheets are initially separated in a predetermined sequence and collected in loose stacks, are transferred to a conveying unit, are opened in the middle on the conveying path and are transferred astride onto an intermediate conveyor connected to the stitching saddle of a stitching device. At the conveying end of the intermediate conveyor, each printed sheet is grasped by a feeding unit at the forward edge of the sheet and is moved against a position stop located on the left hand side on the stitching saddle.

This is carried out in the case of printed sheets of small sizes as well as of large sizes. In other words, the shortest printed sheets on the intermediate conveyor as well as the longest printed sheets travel the same distance from the intermediate conveyor to the position stop on the stitching saddle. The speed V is also the same for all printed sheets and the stitching device sews approximately two hundred printed sheets per minute, i.e., more than three printed sheets per second.

The transfer of the printed sheets from the intermediate conveyor to the stitching saddle requires, for increasing the spacing, a brief acceleration of the printed sheets grasped by the intermediate conveyor and, thus, the transfer is not without problems.

Consequently, printed sheets which have a shorter backfold length and the attendant higher lability than the greatest size that can be processed, are moved over an excessively long distance to the position stop, so that the reliability of a correct transfer is also difficult to achieve.

SUMMARY OF THE INVENTION

Therefore, it is the primary object of the present invention to provide a method and an apparatus, which, in the case of printed sheets having a shorter backfold length than that of the maximum permissible printed sheet size, are capable of improving the reliability of the processing of the printed sheets as they travel from the intermediate conveyor or feeder to the stitching saddle.

In accordance with the present invention, the method includes aligning the trailing edge of a supplied printed sheet on the stitching saddle flush on the right hand side in accordance with one of the top edge and the bottom edge of a book block which has at least been partially sewed by the stitching machine.the method includes aligning the trailing edge of a supplied printed sheet on the stitching saddle flush on the right hand side in accordance with one of the top edge and the bottom edge of a book block which has at least been partially sewed by the stitching machine.

The method of the present invention makes it possible that the transfer of a printed sheet from the intermediate conveyor can take place in a more gentle manner than in the past and the impact of the printed sheets against a position stop provided on the stitching saddle can be substantially reduced.

The method of the present invention makes it further possible that the distance and the speed of a printed sheet travelling from the intermediate conveyor onto the stitching saddle are reduced within the available constant processing cycle. This also results in a smaller impact energy.

Alternatively, due to the shorter travel distance of the printed sheets from the intermediate conveyor onto the stitching saddle, the measure according to the present invention would make it possible to operate with a higher processing cycle, i.e., to achieve a higher throughput of printed sheets within the same time period; on the other hand, this would again reduce the extent of the improved reliability.

An apparatus for carrying out the method according to the present invention includes a stitching device supplied with printed sheets by a feeder. The stitching device includes at least two driven sewing needles for forming at least two seams extending at a right angle relative to the longitudinal extension of a book block. The apparatus further includes a stitching saddle for the stitching device, wherein the stitching saddle connects the feeder at the conveying end thereof in accordance with the cycle of the supplied printed sheets, and wherein the stitching saddle is moved back and forth transversely of the feeding direction of the printed sheets. In accordance with the present invention, the apparatus further includes a positioning unit provided at the stitching saddle, wherein the positioning unit aligns the trailing edge of a printed sheet in accordance with one of the top edge and the bottom edge of a book block which has been at least partially sewed by the stitching device.

The apparatus according to the present invention makes it possible in a simple manner to improve the processing reliability in the case of printed sheets having a shorter backfold length than the maximum permissible backfold length, or the throughput of printed sheets can be increased.

In accordance with an advantageous feature, the positioning unit includes an inserting unit which removes the printed sheets from the feeder, wherein the inserting unit makes it possible to reliably transfer the printed sheets to the stitching saddle.

Alternatively, in order to be able to process printed sheets having different backfold lengths, the inserting unit may be provided with a positioning stop which interacts with the inserting unit and is adjustable relative to the stitching saddle, wherein the positioning stop makes it possible to carry out an adjustment, so that a gentle transfer of the printed sheets between the feeder and the stitching saddle can take place.

A cyclical drive of the inserting unit makes it possible to transfer the printed sheets also without using a positioning stop, for example, by utilizing the friction produced between the inserting unit and the printed sheets.

The inserting unit may be constructed as a slide member or also as an endless belt travelling about parallel axes, wherein one portion of the endless belt faces in conveying direction of the printed sheets the stitching saddle for effecting a frictional engagement with the stitching saddle.

In accordance with a simple embodiment, the positioning device is adjustable in accordance with the size or backfold length of a printed sheet.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

The single FIGURE of the drawing is a schematic illustration of the apparatus according to the present invention including a thread stitching machine for processing printed sheets.

DESCRIPTION OF THE PREFERRED EMBODIMENTS

Before the printed sheets 1, 1' collected in a specified sequence reach the magazine 2 of a printed sheet feeder 3, the printed sheets 1, 1' are gathered in an upstream gathering machine so as to be placed one on top of the other in loose book blocks.

Subsequently, the printed sheets, wherein those having the greatest permissible fold are denoted by 1, and those with shorter folds are denoted by 1', are pulled off successively while maintaining the sequence thereof by a separating device arranged at the magazine 2 and the printed sheets are transferred to a conveyor unit 5 illustrated in the drawing by interacting endless belts, wherein the printed sheets are initially transferred to a feeder 6 with the printed sheets opened at the downwardly hanging side thereof; this is a process which is known in the relevant art and does not have to be explained in further detail.

The feeder 6, on which the printed sheets 1 are now conveyed in an astride position, may be equipped with various printed sheet control units, for example, a sheet control unit 7 which monitors the correctness of the supplied printed sheets 1, 1', and a thickness control unit 8 for determining whether a printed sheet 1, 1', has been opened in the middle.

As illustrated in the drawing, the conveyance of the printed sheets 1, 1' at the feeder 6 is effected by a revolving pulling member 9 with protruding drive members 10, 10' which grasp the printed sheets 1, 1' at the trailing or rearward top edge or bottom edge on a saddle-shaped support 11 following the conveying unit 5.

Arranged at the end of the feeder 6, which may have a relatively longer or shorter conveying length than illustrated, is a stitching saddle 12 which can be moved back and forth at a right angle relative to the feeding direction of the printed sheets 1, 1', wherein the support means of the stitching saddle 12 has approximately the cross-sectional shape of the feeder 6, so that a problem-free transfer of the printed sheets 1, 1' from the conveyor 6 can take place when the stitching saddle 12 and the feeder 6 form a connection at least essentially without steps.

Feeding of the stitching saddle 12 with a printed sheet 1, 1' from the feeder 6 takes place by an inserting unit 14 formed by a revolving belt 13. The inserting unit 14 is driven in accordance with the cycle of the printed sheets 1, 1' moved by the feeder 6 and the stitching saddle 12, wherein the portion 18 of the belt 13 formed by two spaced-apart rollers 16, 17 and resting against a support plane of the stitching saddle 12 facing away from a stitching device 15 acts in a frictionally engaging manner on the printed sheets 1, 1' grasped by the feeder 6 and moves the printed sheets 1, 1' onto the stitching saddle 12 as a result.

The inserting unit 14 can be controlled in accordance with the cycle of the processing of the printed sheets or with a continuous revolving movement. This can be effected by various conventional means.

In the case of a cyclical drive movement of the inserting unit 14, this inserting unit 14 can also assume the function of a positioning unit 19, i.e., it can align the printed sheets 1, 1' with the trailing top edge or bottom edge on the stitching saddle 12 in accordance with the at least partially sewed last book block 20; in the processing direction of the stitching device 15 as illustrated in the drawing, the printed sheets are aligned flush on the right hand side with the sewed book blocks.

The accuracy of the positioning procedure of the printed sheets 1, 1' on the stitching saddle 12 can be improved by using a positioning stop 21, 21' which can be adjusted in accordance with the printed sheet sizes to be stitched.

The drawing further shows in broken lines on the feeder 6 and the stitching saddle 12 the printed sheets 1' having a shorter backfold length than the printed sheets 1 shown in solid lines and having the maximum backfold lengths, wherein the shorter printed sheets 1' are shown on the stitching saddle 12 in the position according to the present invention. Significant is the shorter distance between the leading top edge or bottom edge of the frontmost printed sheet 1' placed on the feeder 6 and the printed sheet 1' on the stitching saddle 12 which assumes the position in which it is flush on the right hand side with the sewed book blocks 20 behind the stitching device 15, as compared to the distance between the printed sheets 1' being moved on the feeder 6.

As further shown in the drawing, the printed sheets 1, 1' moved on the stitching saddle 12 into the stitching or sewing position are lifted to the side by a pivoting movement into the sewing position and are sewn in this position into a book block 20 with other printed sheets 1, 1'.

During the pivoting movement of the stitching saddle 12, the printed sheet 1, 1' is lifted from the inserting unit 14 at a right angle relative to the feeding direction.

The stitching procedure carried out in the sewing position and described in detail in European Applications 0 537 106 and 0 603 126, is schematically illustrated in the drawing by two sewing needles 22 each.

The printed sheets 1, 1' are conveyed on the feeder 6 with regular spacings. On the last conveying section from the feeder 6 onto the stitching saddle 12, the conveying direction is maintained, while the last travel distance for the shorter printed 1' is shortened because these shorter printed sheets are aligned with the trailing top edge or bottom edge 25, 25' on the stitching saddle 12 in accordance with the top edge or bottom edge 26, 26' of the sewed book block stack 27 which develops at a right angle relative to the feeding direction.

A printed sheet 1, 1' is conveyed from the feeder 6 onto the stitching saddle by means of a positioning device which, as illustrated in the drawing, may be constructed of an endless belt 13 as an inserting unit 14, wherein the endless belt 13 travels cyclically about two rollers 16, 17, and wherein the portion 18 of the endless belt 13 adjacent the stitching saddle 12 grasps the printed sheets 1, 1' in a frictionally engaging manner at the feeder 6 and transfers the printed sheets on the stitching saddle 12 into the position of the subsequent sewing process. The exact positioning of the printed sheet 1, 1' on the stitching saddle 12 can be effected by an additional positioning stop 21, 21' which can be adjusted automatically or manually in accordance with the size of the printed sheets 1, 1' to be processed.

Because of the shorter travel distance between the grasping location of the printed sheet 1' on the feeder 6 and the final position on the stitching saddle 12, the conveying speed along this section can be reduced and the additional time available makes it possible to optimize the positioning and treatment of the printed sheets 1'.

The alignment of the trailing edge 25, 25' (top edge or bottom edge) of a printed sheet 1, 1' in accordance with the top edge or bottom 26, 26' of an at least partially stitched book block refers to the manner in which the printed sheets to be processed are arranged in the thread stitcher, since the trailing edge 25, 25' of a supplied printed sheet 1 can be assigned to the top edge or the bottom edge of a book block following the stitching unit or at the stitching unit.

The invention is not limited by the embodiments described above which are presented as examples only but can be modified in various ways within the scope of protection defined by the appended patent claims.

We claim:

1. A method of manufacturing books or brochures with a book block composed of printed sheets thread-stitched at a fold side thereof, the method comprising feeding by means of a feeder in a predetermined sequence printed sheets which are spread in the middle and have downwardly directed side portions to a stitching saddle which interacts with a stitching unit arranged at a right angle relative to the fold of the printed sheets, positioning the printed sheets on the stitching saddle in accordance with a stitching position, aligning a trailing edge of a printed sheet fed to the stitching saddle flush in accordance with one of a top edge and a bottom edge of a book block at least partially sewed by the stitching device, and subsequently transferring the printed sheets to the stitching device for sewing into book blocks.

2. An apparatus for manufacturing books or brochures with a book block composed of printed sheets thread-stitched at a fold side thereof, the apparatus comprising a stitching device, a feeder for conveying printed sheets to the stitching device, the stitching device comprising at least two driven sewing needles for forming at least two seams extending at a right angle relative to a longitudinal extension of a book block, a stitching saddle configured to cooperate with the stitching device, the stitching saddle being connected to an end of the feeder for receiving the printed sheets from the feeder, the stitching saddle being configured to be moveable back and forth transversely of the feeding direction of the printed sheets, further comprising a positioning unit at the stitching saddle for aligning a trailing edge of a printed sheet in accordance with one of a bottom edge and a top edge of an at least partially sewed book block.

3. The apparatus according to claim 2, wherein the positioning unit comprises an inserting unit for grasping a printed sheet at the feeder.

4. The apparatus according to claim 3, wherein the inserting unit comprises a positioning stop, and wherein the positioning stop is configured to be adjusted relative to the stitching saddle.

5. The apparatus according to claim 3, comprising means for driving the inserting unit in accordance with a processing cycle of the printed sheets.

6. The apparatus according to claim 2, wherein the positioning device is adjustable in accordance with a size or backfold length of a printed sheet.

7. The apparatus according to claim 3, wherein the inserting unit is comprised of an endless belt travelling around parallel axes, wherein a portion of the endless belt faces in feeding direction of the printed sheets the stitching saddle for a frictional engagement with the stitching saddle.

* * * * *